US005252888A

United States Patent [19]

Topel et al.

[11] Patent Number: 5,252,888

[45] Date of Patent: Oct. 12, 1993

[54] LAMP CAPSULE SUPPORT BASE

[75] Inventors: A. Charles Topel, Boston; Lewis H. Palmer, III, Marblehead, both of Mass.

[73] Assignee: GTE Products Corporation, Danvers, Mass.

[21] Appl. No.: 814,857

[22] Filed: Dec. 30, 1991

[51] Int. Cl.[5] ..... H01J 61/36; H01K 1/36

[52] U.S. Cl. ..... 313/318; 439/611

[58] Field of Search ..... 313/318, 25, 633; 445/23, 27, 44; 439/611, 616, 86, 604, 605, 617, 619, 935, 936

[56] References Cited

U.S. PATENT DOCUMENTS

| | | | |
|---|---|---|---|
| 467,523 | 1/1892 | Roberts | 439/611 X |
| 1,795,746 | 3/1931 | van Voorhis | 313/318 X |
| 3,253,179 | 5/1966 | Edwards et al. | 313/318 |
| 4,295,076 | 10/1981 | Eckhardt et al. | 313/318 X |
| 4,739,219 | 4/1988 | Hume | 313/633 X |

*Primary Examiner*—Sandra L. O'Shea
*Attorney, Agent, or Firm*—Joseph S. Romanow

[57] ABSTRACT

A support base for a filament or a lamp capsule in a lamp includes a lamp base and a pair of leads extending from the base to the filament or lamp capsule. The base includes a layer of composite material that substantially surrounds the leads and supports them along parts of their lengths within the base. The composite material preferably includes glass beads covered by a layer of epoxy resin.

15 Claims, 3 Drawing Sheets

LAMP CAPSULE SUPPORT BASE

FIELD OF THE INVENTION

This invention relates to electric lamps and, more particularly, to a base structure for supporting a lamp capsule.

BACKGROUND OF INVENTION

It is common in the structure of high intensity lamps to utilize a pressurized inert gas-filled capsule having a long filament and a pair of leads connected from the filament to the lamp base. A prior art lamp 20 is depicted in partially exposed perspective view in FIG. 1. The depicted lamp is used generally in commercial and retail settings to brightly illuminate a particular area such as a store window. A filament capsule 22 is enclosed within a second larger light-transmissive tubular outer envelope 24 that is sealed to the base. The base 26 is a bayonet-style cylindrical enclosure. The lamp 20 is common in European applications and is known as the T or BT style lamp. This lamp operates in the 220–250 volt range. The base is typically constructed of conductive metal, that electrically connects each of the capsule's conductive leads 28 to corresponding contacts in a light fixture socket (not shown). The leads 28 in this example comprise a pair of filament leads 29 that are electrically connected to a pair of base leads 31, which extend upwardly from the base 26 to a point just below the capsule. This configuration provides for easy attachment of the capsule to the base.

It is important to position the capsule 22 appropriately within the light-transmissive portion of the outer envelope 24. It is sometimes also important to position the capsule 22 with respect to base 26. In so positioning the capsule, it may be necessary to extend the leads 28. Since the leads are somewhat smaller in diameter relative to their lengths, they may not have sufficient strength to support the weight of the capsule.

Prior art capsule leads have been supported by surrounding them with a ceramic insert 30 (shown also individually in FIG. 2) that extends from the bottom of the bulb base 26 up to the lower end 32 of the capsule 22. The leads extend along inner, axially-disposed channels 34 in the insert 30. The capsule 22 may be partially seated within preformed indents 36 at the top of the ceramic insert 30. These indents 36 may include recesses for receiving adhesive or cement to permanently seat the capsule in the insert. While the insert 30 satisfactorily isolates the leads 28 and supports the capsule 22, thus preventing bending and twisting of the capsule/-lead structure within the lamp, the insert 30 adds substantial weight to the lamp and is prone to chipping from applied shock and vibration. The ceramic insert is also somewhat expensive due to high material and construction costs and, therefore, contributes to higher lamp construction costs.

It is a general object of the present invention to provide improved capsule supports for lamps that utilize filament capsules.

It is a further object of the present invention to provide a light filament support base, particularly adapted for use with sealed filament capsules, that is lower in weight and cost than conventional ceramic inserts and that exhibits durability equal to or greater than ceramic inserts.

It is another object of this invention to provide a light filament support base that can be utilized with existing lamp components with minimal modification thereof.

SUMMARY OF THE INVENTION

A lamp according to the present invention includes a light-transmissive outer envelope, a lamp capsule, a base and a pair of leads extending from the base to the capsule. The leads electrically connect the base to the capsule and are generally rigid. The base includes an enclosed bottom end and an open top end. To support the leads along a part of their lengths, a layer of granular particles, which preferably comprises glass beads, is positioned in the bottom end of the base. The layer of particles is covered by a layer of resin, preferably epoxy, that forms a composite. The composite surrounds the leads along portions of their lengths, thus providing support to prevent the leads from bending and swaying within the lamp envelope.

The composite support structure should be insulating since the leads are conductive. Alternatively, the leads can be insulated at least along portions of their lengths proximate the base. In this case, the electrical properties of the composite are unimportant.

BRIEF DESCRIPTION OF THE DRAWINGS

The foregoing objects and advantages of the invention will become more apparent with reference to the following detailed description of preferred embodiments and brief description of the drawings in which.

DETAILED DESCRIPTION

Figure 1:
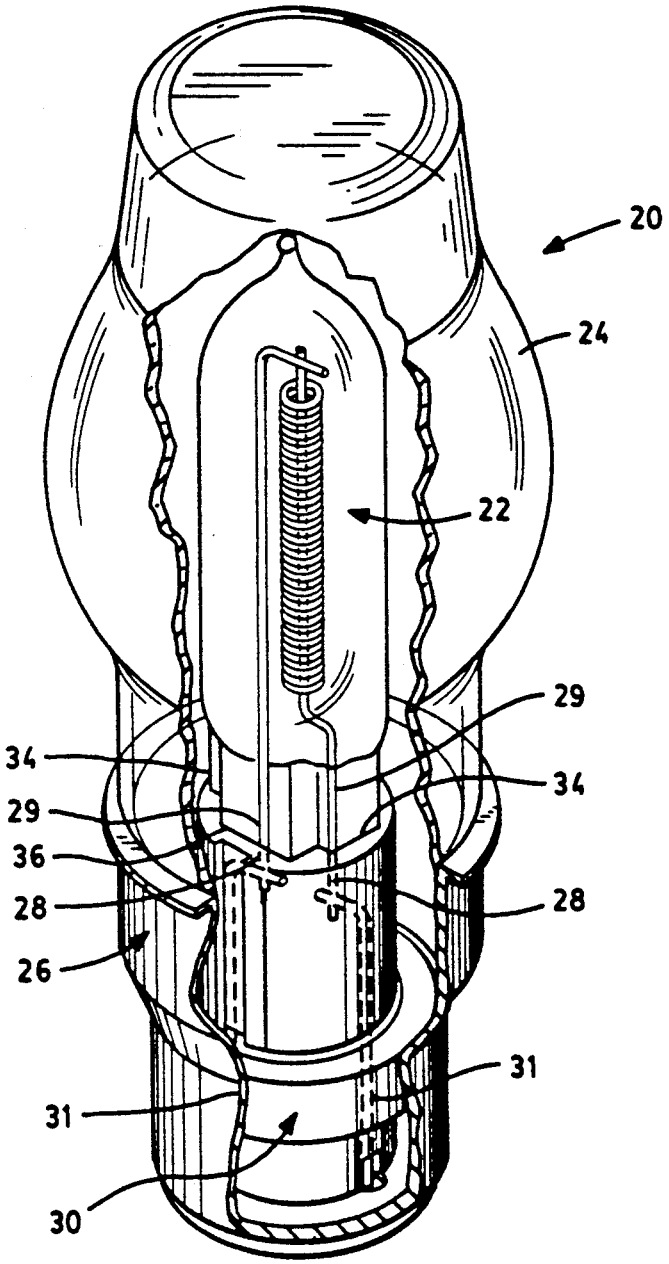
PRIOR ART FIG. 1
FIG. 1 is a partially exposed perspective view of a lamp having a filament capsule supported by a ceramic base according to the prior art.
Figure 2:
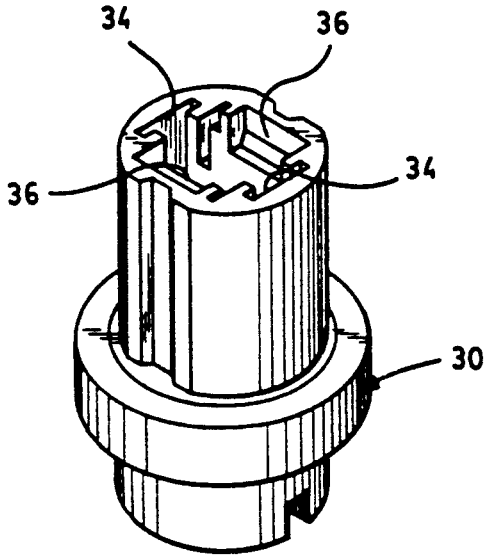
PRIOR ART FIG. 2
FIG. 2 is a perspective view of a ceramic insert of FIG. 1.
Figure 3:
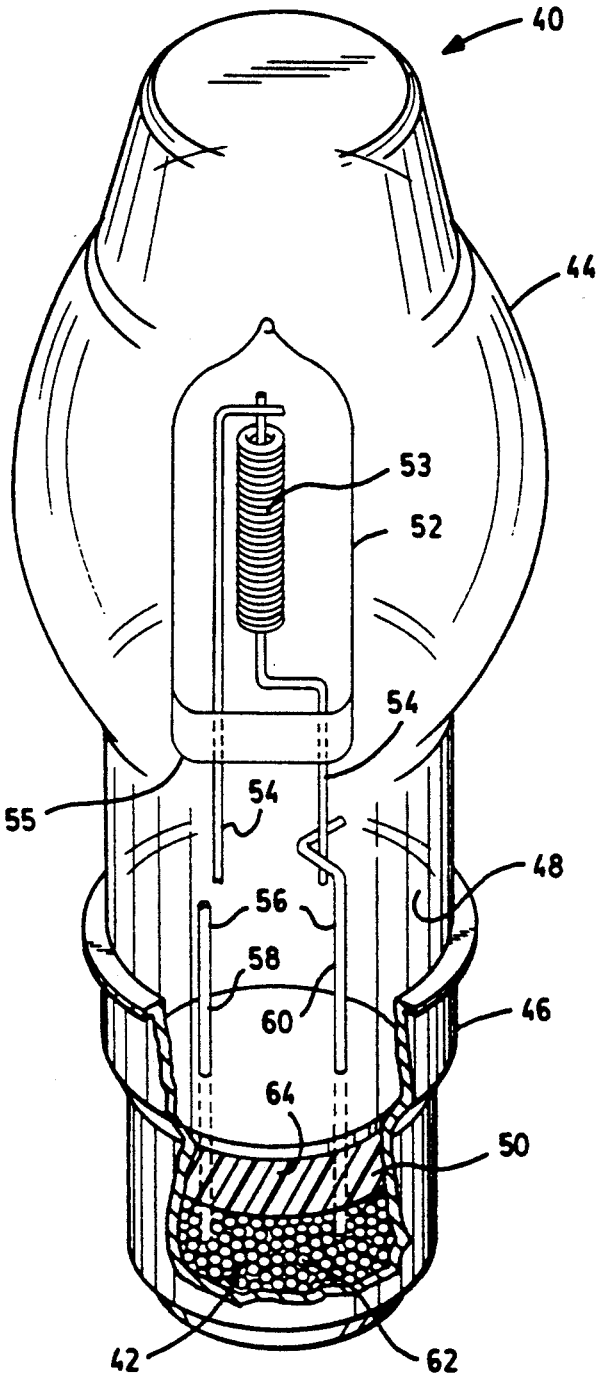
FIG. 3 is a partially exposed perspective view of a lamp having a composite supporting base according to this invention.

A lamp 40 having a support structure 42 according to an embodiment of the invention is depicted in FIG. 3. The lamp 40 includes a light-transmissive envelope 42, typically of high temperature resistant glass or quartz, that is sealed to a substantially cylindrical metallic base 46. The base 46 in this example is a bayonet-style base constructed of conducting metal such as brass that is adapted to interconnect with a lamp socket (not shown). The base has a larger inner diameter 48 proximate its upper open end and a smaller inner diameter 50 proximate its lower closed end.

The lamp 40 includes a lamp capsule 52 that can be conventional in design. The capsule 52 includes a filament 53 and two capsule leads 54 exiting its bottom end 55. Note, as used herein, "upwardly" shall mean a direction from the base 46 into the envelope 44 while "downwardly" shall mean from the envelope 44 into the base 46.

The capsule leads 54 are joined to a pair of somewhat rigid metallic base leads 56. The base leads 56 are joined to contacts (not shown) in the base 46 that interconnect the leads 56 to an electrical source. In FIG. 3, the left base lead 58 is shown only partially, without its interconnection to the capsule, for increased clarity. It should be understood, however, that this lead is connected to the capsule 52 in a manner similar to that shown for the right lead 60. The connection between the base leads 56 and capsule or filament leads 54 can be accomplished by means of welding or similar permanent metal-to-metal connection processes.

Elongated leads are necessary in lamps of the type depicted in FIG. 3 in order to position the filament capsule 52 at a desired position within the envelope 44. If the capsule 52 is positioned close to or within the opaque base 46, part of the transmitted light will be obscured by the base 46.

As noted, however, elongated leads result in sway and rotation of the capsule under applied shock and vibration. The leads 54 and 56 may sway far enough to contact the base 46, causing an undesirable short circuit. Thus, the leads must be supported sufficiently to maintain the capsule 52 at a predetermined position within the envelope 44, despite possible applied shock and vibration to the lamp.

Support of the capsule 52 according to the present invention is accomplished by means of a composite support structure 42 disposed within the smaller diameter portion 48 of the base 46. The structure 42 includes a layer of glass beads 62 of approximately 0.03 inch in diameter filled to a depth of approximately ⅛ inch within the base. Note that the inner diameter of the depicted base is approximately 15 mm.

Other insulating granular substances such as ceramic grindings can be utilized according to the present invention. However, glass is preferred for its high electrical insulating properties, high thermal resistance, and low material cost. The layer of glass beads 62 is then covered by a layer of epoxy resin 64 approximately 1/16 inch thick. The epoxy tends to seep into the interstices between the glass beads forming a solid composite material that surrounds the base leads 56. In this embodiment, Emerson and Cuming 58-1 TM epoxy can be utilized. A composite support structure according to the present invention provides leads with sufficient rigidity within the base to prevent unacceptable sway and rotation of the filament or capsule attached thereto. Note that it may be necessary to utilize reinforced base leads that are more rigid than the conventional leads used in prior art ceramic insert designs. In this embodiment, base leads constructed of nickel-plated iron and having a diameter of approximately 0.04 inch are suitable for most applications.

While electrically insulating particles are preferred, it is possible to utilize base leads that are electrically insulated, In this case, the electrical characteristics of the composite are not critical.

Construction of a lamp according to the present invention is relatively simple in comparison with prior art designs. The two base leads 56 are first welded or soldered to respective contacts on the base 46. The base leads 56 are positioned so that they extend upwardly from the bottom of the base 46 parallel to each other and at a predetermined spacing that corresponds to that of the capsule leads 54. It is important to insure that sufficient space is maintained between the base leads 56 along their entire lengths to prevent inadvertent contact between the leads 56 under applied shock or vibration. Otherwise, an undesirable short circuit would result.

As noted above, a layer of glass beads 62 of predetermined depth is then dispensed into the base 46, followed by a capping layer of epoxy resin 64. Note that other similar adhesives can be utilized, provided that they exhibit sufficient heat resistance and durability to withstand lamp operating temperatures. The capsule leads 54 are then attached to the base leads 56 by conventional means such as welding or soldering. The outer envelope 44 is then mounted in the assembled lamp base 46. If necessary, the envelope 44 can be filled with a gas such as argon, etc.

A layer of glass beads 62 or similar granular particles is considered necessary for a support structure according to this invention. It has been found that if only a layer of catalyst-hardened resin (such as epoxy) is used to fill the entire base, it may exhibit undesirable exothermic characteristics and, consequently, an uneven distribution of the resin may result. Additionally, a layer composed entirely of resin is more expensive. Furthermore, the glass beads or other particles have sufficient air space therebetween for a fuse wire (not shown), often disposed between a lead and the base, to blow in the event of an overload. A layer composed entirely of resin would react undesirably with a fuse wire, by fully encasing it and, thus, preventing it from blowing at the desired load level.

A lamp having composite support structure 42 according to the present invention is substantially lighter in weight and less expensive to produce than a prior art lamp having a ceramic insert. The composite support structure also exhibits superior shock and vibration resistance and suffers significantly less likely to chip and crack from applied shock.

It should be understood that the preceding is merely a detailed description of a possible embodiment. It should be apparent to those skilled in the art that various modifications and equivalents may be made without departing from the spirit or scope of the invention. The preceding description is meant, therefore, to be taken only by way of example and not to otherwise limit the scope of the invention.

What is claimed is:

1. A lamp comprising:
a light-transmissive outer envelope;
a lamp capsule;
a base;
a pair of leads extending from the base to the capsule and electrically connecting the base to the capsule, the base including a support structure including a layer of granular particles filling the base to a predetermined depth and surrounding the leads and a layer of solidified resin of predetermined thickness that covers the layer of granular particles, whereby the leads are supported along portions of their lengths in the base by each layer.

2. A lamp as set forth in claim 1 wherein the granular particles comprise glass beads and the resin comprises epoxy resin.

3. A lamp as set forth in claim 2 wherein the glass beads are approximately 0.03 inch in diameter.

4. A lamp as set forth in claim 1 wherein the base comprises a bayonet-style base.

5. A lamp as set forth in claim 4 wherein the support structure is electrically insulating.

6. A lamp as set forth in claim 4 wherein the particles fill the base to a level of at least ⅛ inch and the resin comprises a layer at least 1/16 inch thick.

7. A lamp as set forth in claim 1 wherein the leads comprise nickel-plated iron and have a diameter approximately 0.04 inch.

8. A method of constructing a lamp including a lamp capsule comprising the steps of:
providing a lamp base, the base being enclosed at a bottom end and open at a top end;
attaching at least two rigid leads to the bottom end of the base;

filling the base to a predetermined depth with granular particles;

covering the granular particles with a layer of solidifying resin, whereby the leads are encased along a predetermined length within the base by the particles and the resin; and attaching a lamp capsule to the lead wires.

9. A method as set forth in claim 8 wherein the resin comprises an epoxy resin and the particles comprise glass beads.

10. A method as set forth in claim 9 wherein the glass beads are approximately 0.03 inches in diameter.

11. In a lamp having a light-transmissive outer envelope, a filament or a lamp capsule, a base, and a pair of leads extending from a closed bottom end of the base through an open top end of the base to the capsule, a support structure for the leads comprising:

a layer of granular particles of predetermined thickness positioned within the base at the bottom end and an overlying layer of resin within the base that covers the layer of particles and extends into interstices between the particles, each layer surrounding the leads and supporting the leads within the base along predetermined lengths thereof.

12. A support structure as set forth in claim 11 wherein the particles comprise insulating granules and the leads include electrically conductive surfaces.

13. A support structure as set forth in claim 12 wherein the granules are glass beads and the resin comprises an epoxy resin.

14. A support structure as set forth in claim 13 wherein the leads comprise nickel-plated iron wires having a diameter of approximately 0.04 inches.

15. A support structure as set forth in claim 14 wherein the base comprises a bayonet-style base and is sized to engage a lamp socket operating in a voltage range of approximately 220–250 volts.

* * * * *